United States Patent [19]

Pelazza

[11] Patent Number: 4,813,165

[45] Date of Patent: Mar. 21, 1989

[54] SNOW REMOVING AND DISSOLVING APPARATUS

[76] Inventor: Maria V. Pelazza, Via Dante No. 4, Cirie', Turin, Italy

[21] Appl. No.: 160,327

[22] Filed: Feb. 25, 1988

[30] Foreign Application Priority Data

Mar. 9, 1987 [IT] Italy ..... 67168 A/87

[51] Int. Cl.[4] ..... E01H 5/10; E01C 19/45

[52] U.S. Cl. ..... 37/228; 126/343.5 R

[58] Field of Search ..... 37/228; 126/343.5 R

[56] References Cited

U.S. PATENT DOCUMENTS

| | | | |
|---|---|---|---|
| 2,104,363 | 1/1938 | Devlin | 37/228 |
| 2,467,659 | 4/1949 | Cayas | 126/343.5 R |
| 2,877,962 | 3/1959 | Flynn | 37/228 |
| 3,066,428 | 12/1962 | Raiti | 37/228 |
| 3,456,368 | 7/1969 | Jacques | 37/228 |
| 3,464,128 | 9/1969 | Krickovich | 126/343.5 R |
| 3,981,296 | 9/1976 | Medina | 126/343.5 R |
| 4,353,176 | 10/1982 | Hess | 37/228 |
| 4,676,224 | 6/1987 | Ohno | 37/228 |

FOREIGN PATENT DOCUMENTS

| | | | |
|---|---|---|---|
| 1297642 | 6/1969 | Fed. Rep. of Germany | 37/228 |
| 363253 | 12/1972 | U.S.S.R. | 37/228 |
| 3486 | 11/1910 | United Kingdom | 37/228 |

*Primary Examiner*—Eugene H. Eickholt

[57] ABSTRACT

Snow removing and dissolving apparatus carried by a self-propelled motor vehicle and formed by at least one rotary drum arranged in front of the vehicle. A screw conveyer picks up the snow collected by the rotary drum and conveys it to a heating chamber to obtain initial liquefaction. The remaining moving snow accumulates in a bin which by a solution having a low freezing point completes the dissolution.

10 Claims, 4 Drawing Sheets

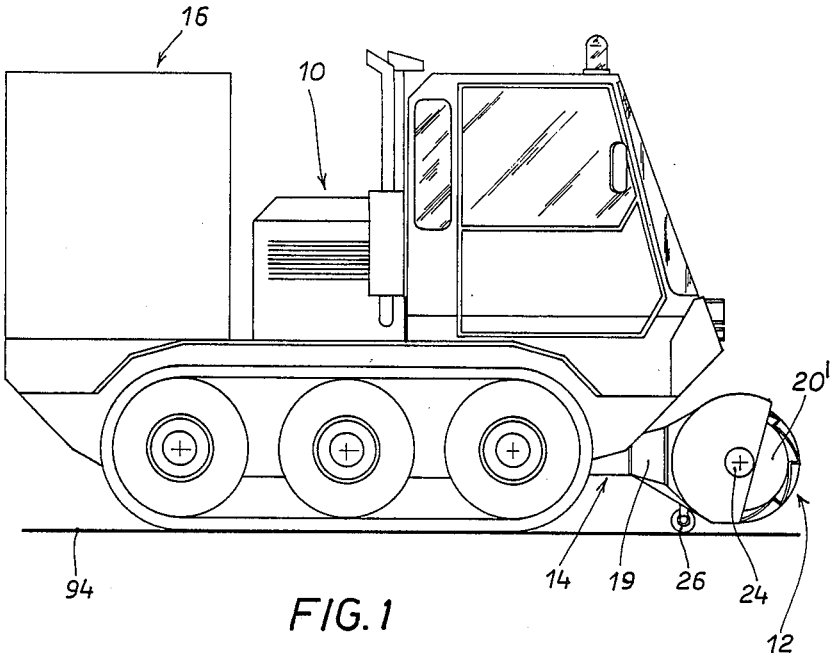
FIG. 1
FIG. 3
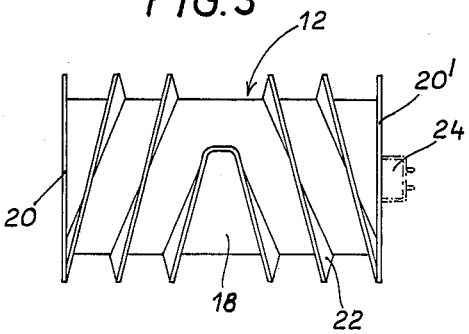

10
12
14
16
19
26
28
30
32
34
36
54
56
58
94

SNOW REMOVING AND DISSOLVING APPARATUS

BACKGROUND OF THE INVENTION

This invention relates to snow removing and dissolving apparatus and in particular to snow removing and dissolving apparatus that can be mounted on self-propelled motor vehicles.

It is known that the removal and clearing of snow, particularly in highly urbanized areas, is effected above all when there has been a heavy snowfall by using normally vehicles such as tractors carrying suitable blades arranged in the front or rear of the vehicle to push the snow to the sides of the snow-covered area, but freeing it only partially and leading to the impossibility of using the entire surface of the area. Thus, the complete removal must take place at a second stage by vehicles which transport the snow to suitable places where it does not form an obstacle, or discharge it into watercourses in the vicinity.

This operation requires numerous manpower which is often difficult to find and to organize and the cost of which is always high.

Moreover, this operation must be carried out in time to avoid holding up the traffic for a long time, resulting in a reduction of the practicable area, and not run the risk of making the removal impossible due to sudden frost.

Snowplows are known which are equipped to effect the removal of snow by rotors or rotary drums arranged in front of the vehicle to collect the snow from the roadway and, due to the very high speed of rotation, throw it away to drop it sideways at a considerable distance, thus freeing the road surface completely.

Such a system can be advantageously used in places without laterally adjacent buildings or areas that must remain free, for example, roads away from cities or country or mountain roads. Obviously the use of such a system in urban areas or in the vicinity of houses is impracticable.

It is therefore an object of the present invention to eliminate or reduce the drawbacks and disadvantages of the present vehicles used for removing snow and to provide apparatus which in addition to a snow removing operation simultaneously carries out a snow dissolving operation, thus reducing drastically the subsequent manual work of cleaning the road surface and therefore limiting the consequent cost of manpower involved therein.

A further object of the present invention is to provide apparatus which, in addition to permitting the snow to be dissolved, prevents the residual liquid from freezing on the surface onto which it has flowed to the outside.

SUMMARY OF THE INVENTION

The above and other objects and advantages, which will become apparent from the following description, are achieved by snow removing and dissolving apparatus carried by a self-propelled vehicle comprising at least one rotary drum arranged in front of the vehicle and carrying on its peripheral surface at least one helical cutting member defining a plurality of blades for cutting and conveying the snow.

The improvement provided by the present invention further comprises:

(a) a screw conveyer arranged parallel to the direction of traveling of the vehicle and formed by a spiral arranged for rotation around a horizontal axis in the interior of a tubular guide member of said conveyer, said spiral being rotatably supported between a support arranged forwardly thereof and drive means arranged rearwardly thereof;

(b) a pump connected to distribution means and adjustment means for hydraulic fluid for heating a sealed chamber surrounding a rear portion of said screw conveyer and a sheath of pipes wound in spirals around said tubular guide member in the interior of said sealed chamber;

(c) a snow collecting and dissolving bin sealingly connected to said screw conveyer, drive means for rotation of snow stirring members, and sucking means and distribution means for a solution having a low freezing point and contained in the interior of said bin, said solution being arranged above the snow in said bin and being separated therefrom by a partition;

(d) distribution means for distribution of the dissolved snow on the ground.

BRIEF DESCRIPTION OF THE DRAWINGS

FIG. 1 is a side view of a self-propelled vehicle equipped with snow removing and dissolving apparatus according to the invention;

FIG. 3 is a front view of a rotary drum according to the invention;

DESCRIPTION OF PREFERRED EMBODIMENT

Figure 2:
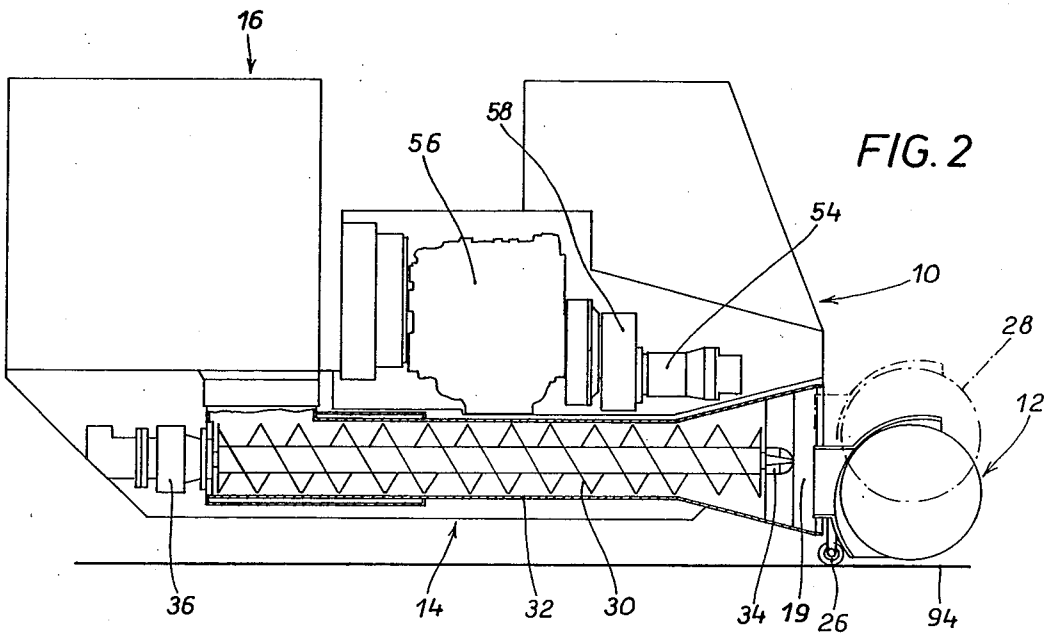
FIG. 2 is a schematic side view of a self-propelled vehicle with the portion of the apparatus for conveying the snow, partially in section.

Referring to FIGS. 1, 2 and 3, a self-propelled vehicle 10, for example, a tractor, tracklaying tractor or a truck serving as a tractor, is equipped with snow removing and dissolving apparatus formed substantially by a rotary drum 12 arranged in front of the vehicle, by a screw conveyer 14 arranged parallel to the direction of traveling of the vehicle, and by a bin 16 for dissolving the snow, arranged in a rear portion of the self-propelled vehicle.

The rotary drum 12 is formed by a central cylinder 18 carrying at its opposed ends a pair of circular closure surfaces 20, 20'.

Arranged on the peripheral surface of the drum 12 is at least one blade 22 winding around the drum in a helical path so as to be able to collect the snow from the road surface and push it toward an inlet 19 of the screw conveyer 14.

The drum 12 is set into rotation by a hydraulic motor 24 arranged substantially on a side surface of the drum. A pair of wheels 26 (shown in FIG. 1) running on the ground and arranged below the rotary drum 12 provides for balanced support of the drum and simultaneously defines the minimum working level of the drum relative to the road surface to avoid, as far as possible, damage resulting from the blade 22 abutting against irregularities and obstacles on the road surface.

Further, as shown in FIG. 2, the rotary drum 12 can move vertically to assume a multiplicity of positions such as, for example, that shown in FIG. 2 by a dash-and-dot line indicated by the numeral 28, by the operation of lifting and moving means, not shown, as they are known to those skilled in the art.

The snow collected by the rotary drum 12 is pushed into the inlet 19 of the screw conveyer 14 and picked up by a spiral 30 rotating in the interior of a tubular guide member 32 and is conveyed toward the rear portion of the screw conveyer 14.

The spiral 30 is supported forwardly by a support 34 carried by the structure of the screw conveyer 14 and rearwardly is connected to a hydraulic motor 36 which imparts to it the rotary motion for conveying the snow. A plurality of holes 38, 38', 38" arranged in the lower portion all along the tubular guide members 32 permits the water formed by the initial dissolving of the snow to flow off to the ground below.

Figure 4:
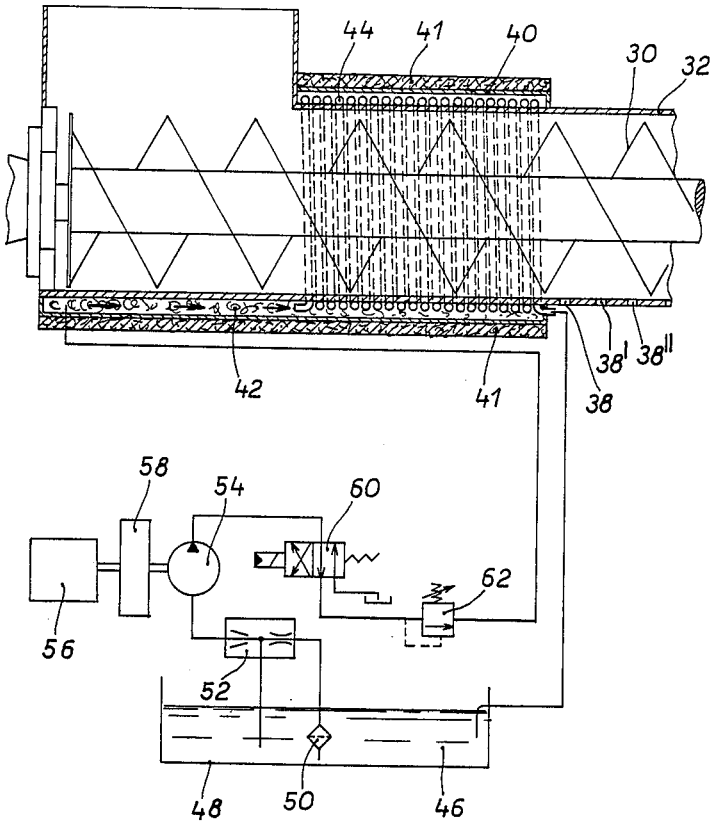
FIG. 4 is a partial side view in vertical section and partly broken away of a portion of the screw conveyer for conveying the snow and a simplified diagram of a hydraulic circuit connected to the conveyer and forming part of the snow removing and dissolving apparatus according to the invention.

Referring to FIG. 4, a partition 40, which surrounds the end portion of the tubular guide members 32, permits to obtain a chamber 42 heated by hydraulic fluid 46 set into circulation by a hydraulic plant which will be described in detail hereinafter.

Obviously the partition 40 is insulated outwardly to reduce heat dispersion. This insulation, indicated by the numeral 41 in FIG. 4, is obtained by using appropriate materials such as, for example, rock wool, impregnated tapes, etc. according to methods known to those skilled in the art.

Further, a sheath of pipes 44 formed by at least one pipe wound in serpentine fashion around the tubular guide members 32 and arranged in the interior of the heating chamber 42, is heated by the hydraulic fluid 46 circulating therein, so as to permit the best possible exchange of heat between the hot surface of the sheath of pipes in contact with the snow and the snow itself.

The hydraulic fluid 46 contained in a tank 48 is sucked in through filters 50, 52 by a source of pressure 54 formed, for example, by a hydraulic pump connected in series with a reduction gear 58 and an endothermic engine 56.

A hydraulic distributor 60 forms means for intercepting the hydraulic fluid and has two positions, a position of communication and a discharge position, respectively, while a valve 62 regulates the maximum operating pressure.

The hydraulic fluid brought to a high pressure by the pump 54 (on an average the operating pressure is about some hundreds of bars) actuates the valve 62 on reaching a predetermined pressure to then fill the heating chamber 42.

A high flow rate of the pump and a high pressure to which the hydraulic fluid is subjected, and a relatively narrow flow aperture permitted by the pressure regulating valve 62, lead to an automatic and constant increase in temperature of the hydraulic fluid so as to heat both the chamber 42 and the sheath of serpentine pipes 44 arranged, as described previously, in the interior of the heating chamber 42.

The hydraulic fluid, in addition to filling the chamber 42 by pressure values lower than those prevailing upstream of the valve 62, also circulates in the interior of the sheath of pipes 44 to flow out and be discharged into the tank 46.

Figure 5:
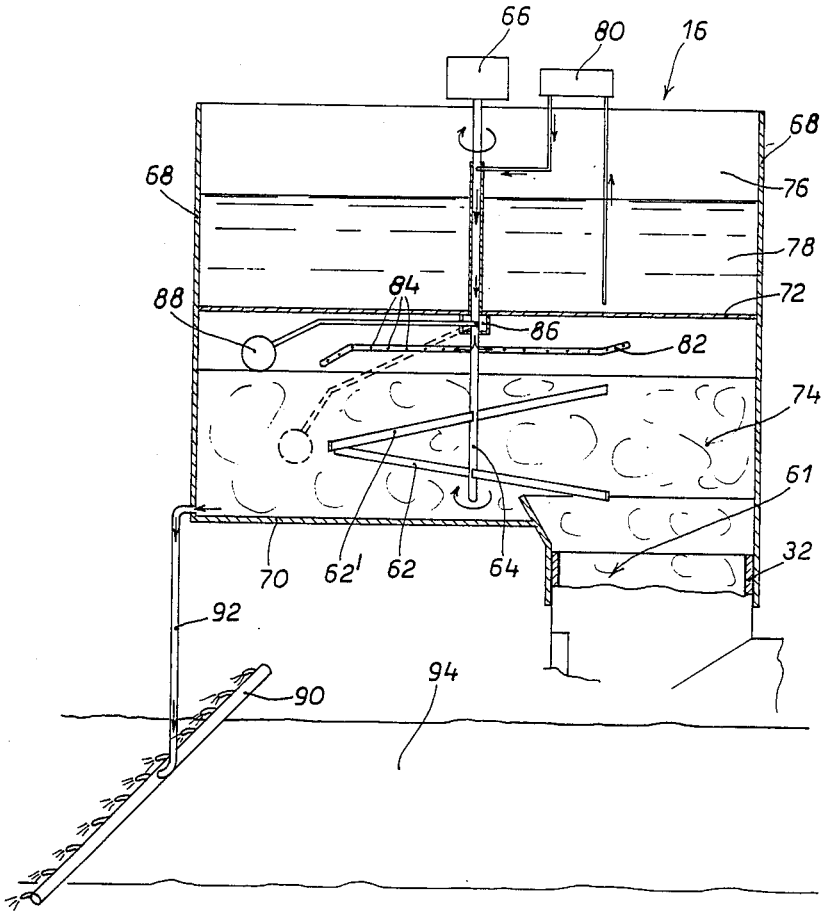
FIG. 5 is a side view, partly in section, of the portion of the apparatus representing the area for dissolving and discharging the snow according to the invention.

Referring now to FIG. 5, the wet snow that has accumulated in the rear portion of the screw conveyer 14 due to the rotation of the spiral 30 tends to lift and fill initially a connection duct 61 for connection between the tubular guide member 32 and the inlet of the bin 16 and then flow into the interior of the bin in the lower portion thereof.

A blade stirrer formed by a motor 66 imparts rotary motion to a hollow shaft 64 connected thereto and to stirrer members 62 and 62' secured to the hollow shaft 64 and rotating in the interior of the mass of snow to prevent it from coming to rest and thus solidify by freezing.

The bin 16 substantially comprises four side walls 68 forming a parallelepiped and a bottom 70 for retention and support on the self-propelled vehicle 10, but any other geometric form suitable for the purpose can be used.

A partition 72 is arranged in a horizontal position in the interior of the bin 16 so as to form two separate sealed chambers the lower one 74 of which, as described previously, contains the wet snow coming from the conveyer 14 whereas the upper one 76 forms a reservoir for a liquid 78 having a low freezing point, for example, a solution of calcium chloride and water or other liquids suitable for the purpose.

A pump 80 placed outside the bin sucks in the liquid 78 to pour it thereafter into the hollow shaft 64.

Said liquid 78 is then distributed over the wet mass of snow by a perforated rotor 82 rotating horizontally around its vertical axis due to the pressurized liquid discharged from a plurality of holes 84 made over the entire extension of the rotor 82.

A distributor valve 86 connected to a float 88 regulates the outlet flow of the liquid 78 having a low freezing point in a manner directly proportional to the quantity of snow present in the storage chamber 74 of the bin 16.

The liquid 78 poured onto the mass of snow causes a further dissolution of the latter, thus completing the process of liquefaction started in the heating chamber 42 of the screw conveyer 14.

The aqueous solution thus obtained is distributed on the ground by a tube 92 which feeds a multiple jet spreader 90 arranged at a height slightly above the plane formed by the road surface 94.

Although a preferred embodiment of the invention has thus been described by way of example and with reference to the accompanying drawings, it is to be understood that the invention is not limited to this precise embodiment and that numerous changes and modifications obvious to one skilled in the art may be made therein without departing from the scope of the invention as defined by the appended claims.

For example, the apparatus may be provided with a supporting structure capable of permitting also transverse movement of the rotary drum 12 in addition to the vertical movement thereof hereinbefore described.

In this manner also spaces could be covered that are located laterally of the self-propelled vehicle, such as sidewalks, pedestrian islands, etc.

I claim:

1. In snow removing and dissolving apparatus carried by a self-propelled vehicle comprising at least one powered rotary drum arranged in front of the vehicle and carrying on a peripheral surface thereof at least one helical cutting member defining a plurality of blades for cutting and conveying the snow, the improvement comprising:

(a) a screw conveyer arranged parallel to the direction of traveling of the vehicle and formed by a spiral arranged for rotation around a horizontal axis in the interior of a tubular guide member of said conveyer, said spiral being rotatably supported between a support arranged forwardly thereof and drive means arranged rearwardly thereof;

(b) a pump connected to distribution means and adjustment means for hydraulic fluid for heating a sealed chamber surrounding a rear portion of said screw conveyer and a sheath of pipes wound in spirals around said tubular guide member in the interior of said sealed chamber;

(c) a snow collecting and dissolving bin sealingly connected to said screw conveyer, drive means for rotation of snow stirring members, and sucking means and distribution means for a solution having a low freezing point and contained in the interior of said bin, said solution being arranged above the snow in said bin and being separated therefrom by a partition;

(d) distribution means for distribution of the dissolved snow on the ground.

2. Snow removing and dissolving apparatus as claimed in claim 1, wherein said drive means for said spiral is formed by a hydraulic motor.

3. Snow removing and dissolving apparatus as claimed in claim 1, wherein holes arranged in a lower portion of said tubular guide member constitute elements for discharging the water formed by an initial dissolution of the snow.

4. Snow removing and dissolving apparatus as claimed in claim 1, wherein said distribution means and said adjustment means are constituted by a hydraulic distributor and a pressure check valve, respectively.

5. Snow removing and dissolving apparatus as claimed in claim 1, wherein said apparatus further comprises an insulation wound around said heating chamber.

6. Snow removing and dissolving apparatus as claimed in claim 1, wherein said drive means for said snow stirring members is formed by a hydraulic motor.

7. Snow removing and dissolving apparatus as claimed in claim 1, wherein said snow stirring members are formed by blades arranged perpendicularly to a motion transmitting shaft.

8. Snow removing and dissolving apparatus as claimed in claim 1, wherein said sucking means and said distribution means are formed by an electric pump and a perforated rotor respectively.

9. Snow removing and dissolving apparatus as claimed in claim 1, wherein said solution having a low freezing point is formed by an aqueous solution of calcium chloride.

10. Snow removing and dissolving apparatus as claimed in claim 1, wherein said distribution means for distribution of the dissolved snow on the ground is formed by a multiple jet spreader fed by a tube.

* * * * *